United States Patent [19]

Clover, Jr.

[11] Patent Number: 4,583,661

[45] Date of Patent: Apr. 22, 1986

[54] MOISTURE-PROOF CONTAINER

[75] Inventor: William M. Clover, Jr., Trabuco Canyon, Calif.

[73] Assignee: Kirstine/Hendricks, Irvine, Calif.

[21] Appl. No.: 647,980

[22] Filed: Sep. 6, 1984

[51] Int. Cl.[4] ..... B65D 83/04

[52] U.S. Cl. ..... 222/42; 222/142.9; 222/182; 221/5; 206/534; 206/538

[58] Field of Search ..... 222/142.9, 42, 182; 221/5; 215/352, 349; 206/534, 538

[56] References Cited

U.S. PATENT DOCUMENTS

| | | | |
|---|---|---|---|
| 1,349,716 | 8/1920 | Elliot . | |
| 1,621,514 | 3/1927 | Mann . | |
| 1,817,562 | 8/1931 | Hodge . | |
| 2,236,224 | 3/1941 | Raschkind . | |
| 2,302,186 | 11/1942 | Caretto . | |
| 2,469,034 | 3/1949 | Garris . | |
| 2,655,288 | 10/1953 | Caretto . | |
| 2,718,336 | 9/1955 | Rochow . | |
| 2,774,466 | 12/1956 | Liska . | |
| 2,890,816 | 6/1959 | Horland . | |
| 2,903,127 | 9/1959 | Dorman . | |
| 2,953,242 | 9/1960 | Shaw . | |
| 2,971,681 | 2/1961 | Galbierz . | |
| 3,198,400 | 8/1965 | Roehrich | 222/182 |
| 3,311,250 | 3/1967 | Lodding et al. | 215/352 X |
| 3,335,915 | 8/1967 | Shannon . | |
| 3,358,818 | 12/1967 | Davis . | |
| 3,439,841 | 4/1969 | Rhodes | 222/142.9 |
| 3,561,592 | 2/1971 | McCool . | |
| 4,288,006 | 9/1981 | Clover, Jr. | 222/42 |

*Primary Examiner*—Joseph J. Rolla
*Assistant Examiner*—Louise S. Heim
*Attorney, Agent, or Firm*—Knobbe, Martens, Olson & Bear

[57] ABSTRACT

A moisture-proof, cylindrical container is provided having a plurality of storage compartments for the receipt of various types of pills or other such items. A selector plate is rotatably mounted on the container to a position wherein an aperture in the plate is aligned over any one of the storage compartments to allow the introduction or removal of pills from that compartment. Indicia on the outside of the container adjacent the storage compartments identify the contents of that compartment. A cap secured to the container body over the selector plate, includes a threaded portion adapted to engage the container body below the indicia identifying the contents of the compartments.

6 Claims, 8 Drawing Figures

MOISTURE-PROOF CONTAINER

BACKGROUND OF THE INVENTION

This invention relates to the field of dispensers and more particularly, to pill dispensers having a plurality of compartments for the convenient storage of various types of pills for use by an individual.

With increased use of vitamins, as well as therapeutic pills, it has become desirable to have a pill storage device which may be conveniently used by the individual as a dispenser of a variety of pills. Typically, the individual will be using several different vitamins or therapeutic pills, requiring a multi-compartment device that is easy to use at home or to take on a trip. Such a dispenser must be constructed to permit easy identification of the pills in each chamber and trouble-free, selective removal of pills from the correct chamber. One such device is described in my U.S. Pat. No. 4,288,006 for Multi-Compartment Container, assigned to the common assignee. Though the device described in my prior patent meets many of the needs for a convenient and reliable dispensing device, some of the features that add to the convenience of that device detract from its moisture-resistant properties. For example, though the device utilizes a rotatable cap having dispensing holes which provide a convenient dispensation mechanism, such a construction results in a loose seal between the cap and container body as well as about the dispenser spout. Because the surfaces of the container body, cap, and cover plate are adapted for relative movement therebetween, the opposed surfaces will wear in use and therefore, degrade the moisture-resistance of the seals therebetween. Additionally, moisture may enter the container body through the joint between the container base and the cylindrical portion.

In view of the increased use of vitamins and heightened interest in the effectiveness of various types of pills, preservation of the effectiveness of those pills has become a matter of major concern to consumers and health officials. Numerous types of daily vitamin and mineral supplements are, for example, currently marketed in moisture-proof packages which preserve the potency of the packaged group of pills for prolonged periods. Moreover, in view of the expense of some pills and the fact that many pills are used only on an irregular basis, it becomes economically as well as medically desirable to preserve the effectiveness of such pills for as long as possible. Thus, it is desirable to provide a pill dispenser that has the advantages of convenience and easy identification of the pills being dispensed, while highly moisture-resistant when not in active use.

SUMMARY OF THE INVENTION

The present invention addresses the above-described objects and advantages by providing a moisture-proof container having a plurality of compartments which may be used to conveniently dispense a variety of different types of pills. The container comprises a generally cylindrical-shaped body having an integral bottom portion and an open upper end. The interior of the container body is provided with a plurality of walls arranged to define a plurality of compartments or chambers, having a generally wedge-shaped cross-section, and extending vertically substantially the length of the container body.

The container body is further provided with an outer portion adjacent the upper end which is adapted to receive indicia to label the contents of the chambers disposed within the body adjacent respective indicia. The container body is further provided with an outer threaded portion disposed beneath the indicia adapted to engage a sealing cap.

A selector plate is provided which may be rotatably mounted on the upper end of the container body. The selector plate has an aperture sized to conform to the generally wedge-shaped chambers to permit selective dispensing and refilling of the contents of each chamber. The selector plate is also provided with a projecting portion adapted to facilitate manual rotation of the selector plate and also adapted to serve as a funnel around the aperture.

The container further includes a sealing cap adapted for rotatable engagement to the container body. The sealing cap is provided with a gasket disposed about the upper inner surface of the cap which forms a moisture-proof seal when the cap engages the container body. The cap has an inner threaded portion spaced from the upper surface of the cap to facilitate engagement of the outer threaded portion of the container body beneath the compartment indicia.

DETAILED DESCRIPTION OF THE INVENTION

Figure 1:
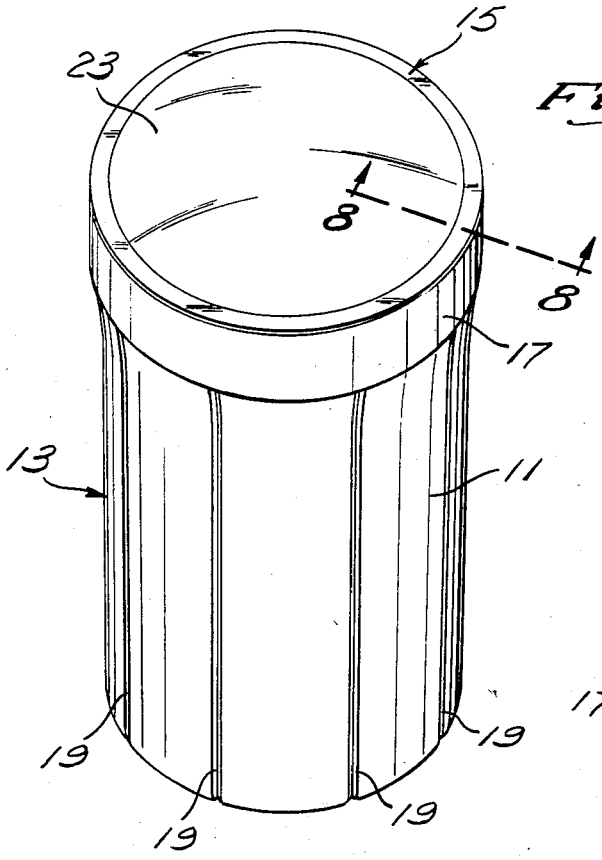
FIG. 1 is a perspective view of the moisture-proof multi-compartment container of the invention.
Figure 3:
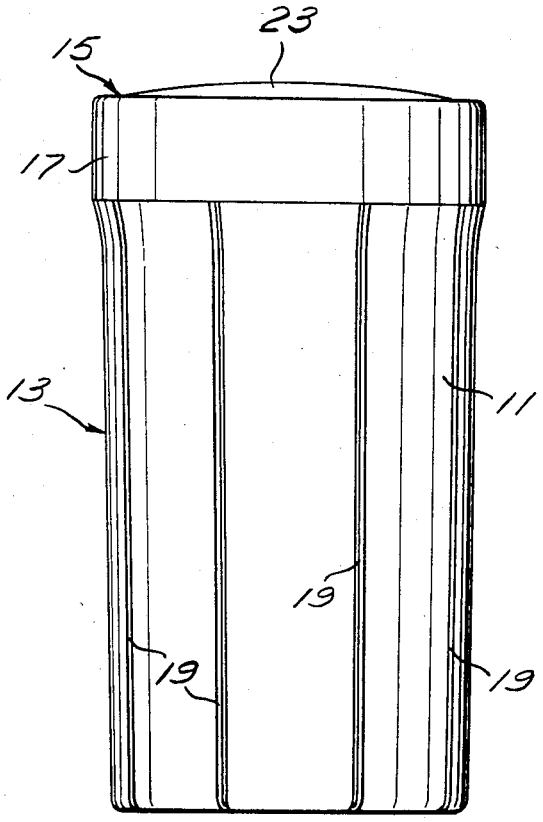
FIG. 3 is a front elevational view of the container.
Figure 2:
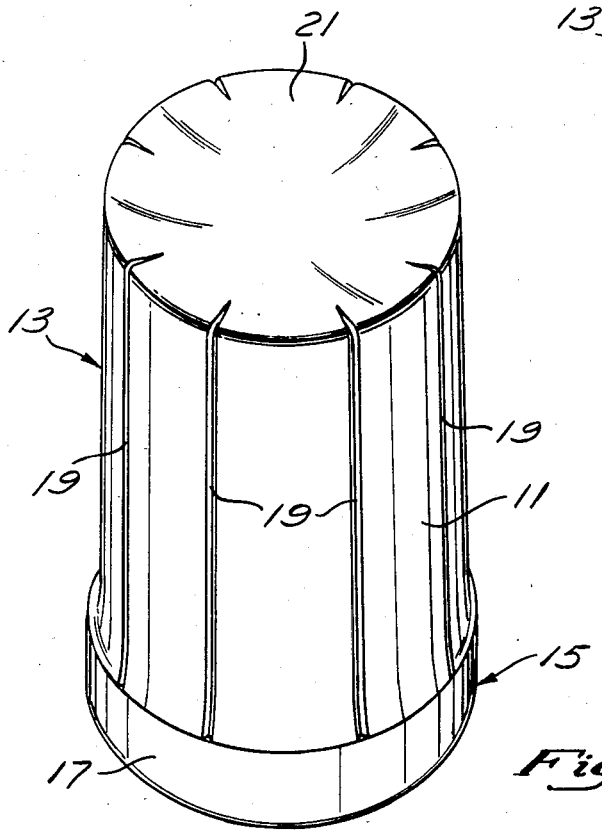
FIG. 2 is a perspective view of the container shown in an inverted position.

With reference to FIGS. 1, 2, and 3, dispenser container 11 of the present invention is shown having a cylindrical body 13 and a sealing cap 15 rotatably coupled thereto. Sealing cap 15 is illustrated in sealing engagement with body 13 and includes a cylindrical skirt 17 surrounding the upper end of the body 13 and a domed upper wall 23 covering the upper end of the cylindrical body. Spaced vertical grooves 19 disposed along the exterior of cylindrical body 13 and generally indicate the boundaries between various chambers within body 13, shown at FIG. 7.

Figure 7:
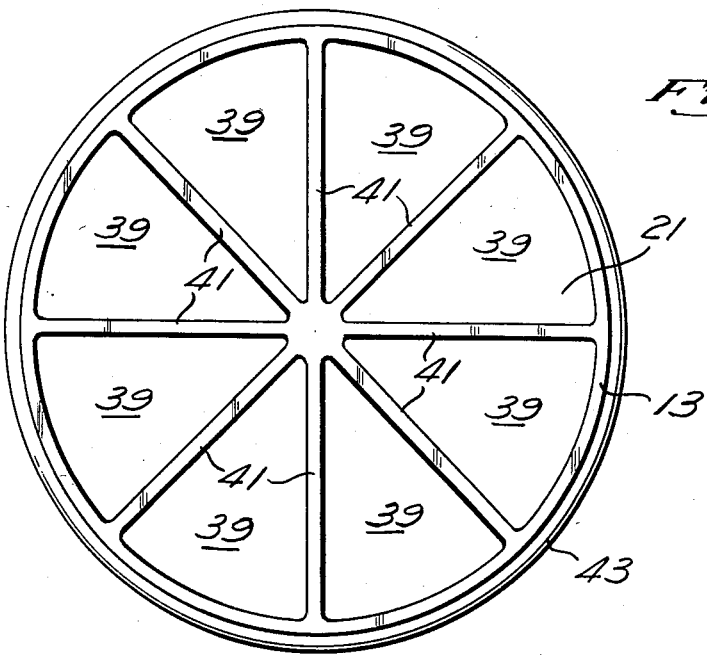
FIG. 7 is a top view of the container body.

As illustrated in FIG. 7, chambers 39 are defined by a plurality of walls 41 disposed axially from the center of body 13, and extending vertically substantially the height of body 13. In practice it has been found that a suitable container is constructed by providing eight vertically extending walls within body 13 to separate body 13 into eight individual, wedge-shaped compartments 39. A bottom wall 21 is formed integral with the body 13 so as to eliminate a joint therebetween where moisture may enter the container.

In practice, it has been found that storing and dispensing functions are conveniently effected in a container having a container body of approximately 3.5 inches in diameter at the base and 3.7 inches in diameter at the upper open end although other sizes, partially shorter are very useful. Such a container is preferably formed of a suitable plastic material such as polyethylene, or the like, having a wall thickness of approximately 0.080 inches. Cap 15 may be formed of similar material and has been conveniently constructed to have a diameter of approximately 3.8 inches. Cap 15 incorporates a skirt which preferably is approximately 0.92 inches in height, and also includes a domed upper wall 23 having a crown of approximately 0.125 inch.

Figure 4:
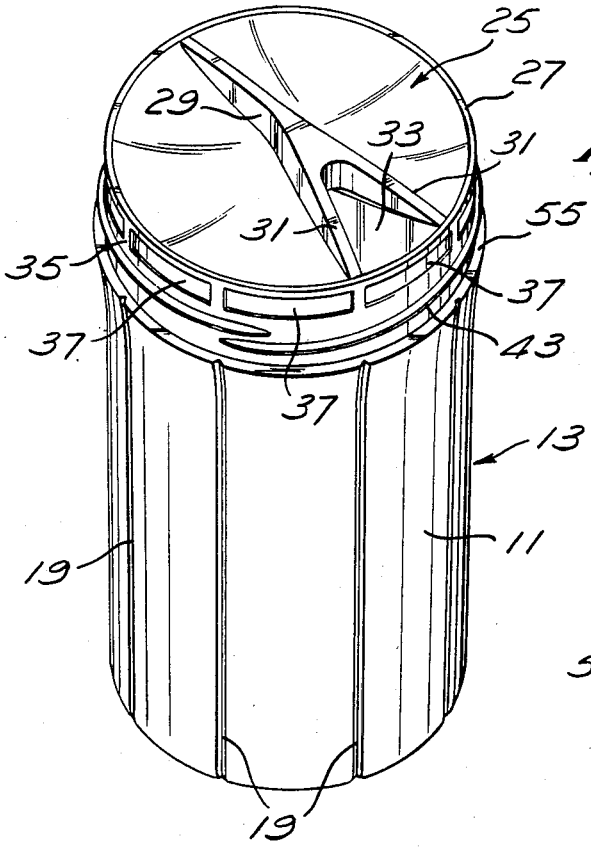
FIG. 4 is a perspective view of the container with the sealing cap removed, exposing the upper surface of the selector plate.
Figure 6:
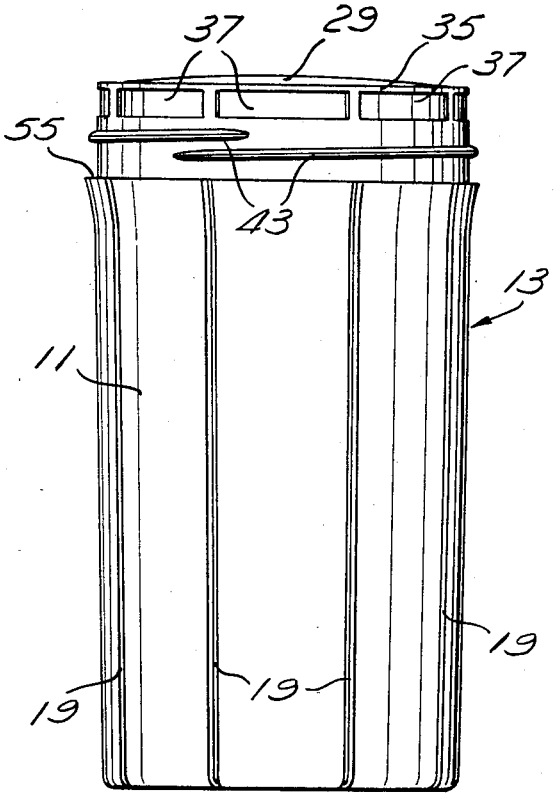
FIG. 6 is a front elevational view of the container body with the selector plate in place.
Figure 5:
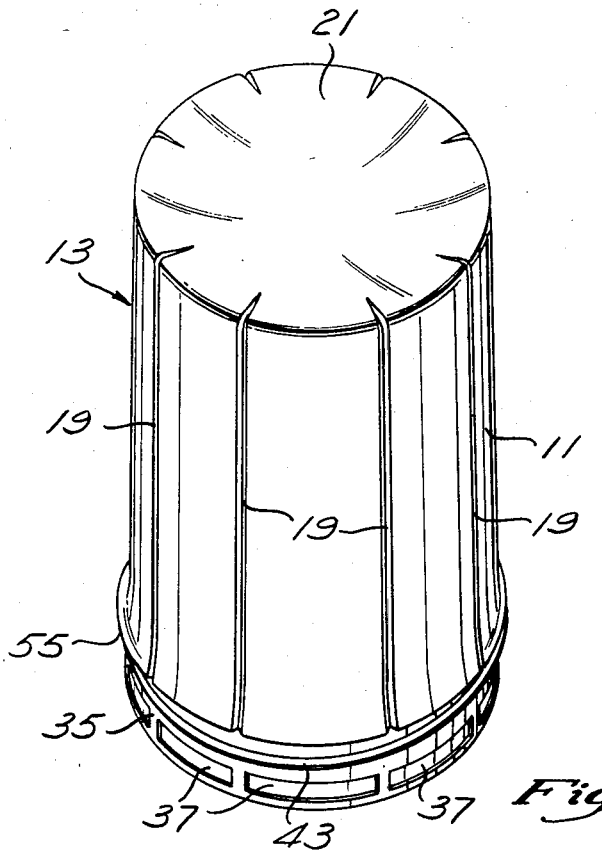
FIG. 5 is a perspective view of the container body shown in an inverted position.

FIG. 4 illustrates a selector plate 25 disposed on the upper end portion of the body 13. Selector plate 25 may be conveniently constructed to have a slightly concave shape extending into body 13 to conveniently seat the selector plate within the upper rim 27 of body 13. Plate 25 is preferably provided with an arched projection 29 having a Y-shape which extends upwardly and facilitates manual rotation of the selector plate about the upper rim 27. The projection 29 includes a fork-shaped region 31, that defines an aperture 33 formed in the selector plate 25. Aperture 33 generally coincides with the size and shape of the chambers 39 disposed within body 13 (FIG. 7). The portions 31 of the projection 29 guide the movement of pills into or out of the compartments.

As shown at FIGS. 4, 5, 6 and 8 body 13 is provided with an upper outer region 35 having a plurality of rectangular recess extending about the circumference of body 13. The recesses 37 are disposed adjacent to and aligned with the wedge-shaped chambers 39 (see FIG. 7) formed in the body 13. The recesses 37 are adapted to receive indicia labeling the contents of the adjacent wedge-shaped chamber. The present construction allows the indicia to be located in close proximity to the aperture so that the consumer can easily identify the contents of each respective chamber with a high degree of confidence that no mistake has occurred. The recesses 37 provide clearance so that the indicia applied therein will not be worn against the inner surface of cap 15 when the cap is engaged to the body. The recesses also serve to avoid wearing of the indicia as a result of handling of the container body.

In order to provide indicia immediately adjacent the aperture to the selected chamber, an outer threaded portion 43 is disposed about the circumference of body 13, below the recesses 37. By constructing cap 15 to have threads similarly spaced from the upper inner surface, container 11 may be sealed without damaging the identifying labels. Note that the cap skirt is spaced slightly from the recesses 37.

Figure 8:
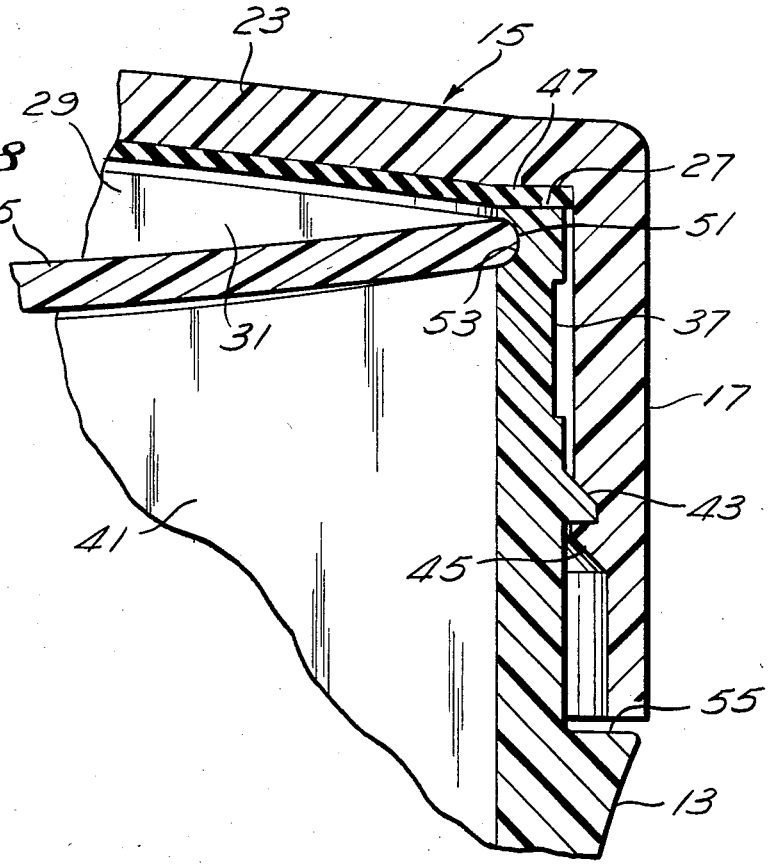
FIG. 8 is an enlarged sectional view of the container along line 8—8 of FIG. 1 illustrating the container seal and the mounting of the cap.

As shown in FIG. 8, cap 15 is provided with a sealing ring or disc 47 extending about the upper inner surface thereof, sealing and extending over the surface of upper rim 27. As thread 45 of cap 15 engages thread 43 of body 13, the sealing ring 47 is drawn into sealing engagement with upper surface of rim 27. A shoulder 55 on the containing body is clearly spaced from the lower edge of the cap skirt when the cap is fully engaged with the body.

Clearance between the inner surfaces of cap 15 and the outer surface of the container body 13 is narrow near the top of the body 13, and wider below the thread engaging surfaces. In practice, clearance near the top of the body 13 is approximately 0.002 inch. This permits a close fit between the cap and the container body. As previously described, recess 37 provides additional clearance to reduce the potential wear on the indicia disposed therein.

As is also shown in FIG. 8, the outer periphery 51 of the selector plate 25 is adapted to fit within annular groove 53 which extends about the upper inside edge of body 13. Edge and groove 53 cooperate to permit the selector plate 25 to snap-fit in the upper portion of body 13. Selector plate 25 may rotate within groove 53 to permit aperture 3 to be disposed above any of the chambers 39. Domed portion 23 of cap 15 is provided with a sufficient arch to accommodate the height of arched projection which extends from selector plate 25.

What is claimed is:

1. A moisture-proof, multi-compartment container comprising:

a container having side walls, a bottom wall and an open upper end, a plurality of walls disposed within said body arranged to define a plurality of chambers in combination with the chamber side walls and extending vertically substantially the length of said body to open to said open upper end, and an upper outer series of shallow recesses disposed adjacent said chambers, each adapted to receive a label to identify the contents of said chambers;

a selector plate rotatably mounted on said upper open portion of said container body, said selector plate having a selector aperture to be selectively aligned with one of said chambers for dispensing product from the selected chamber; and a sealing cap adapted to engage said container body to form a moisture-proof seal therewith, said cap extending over and around the upper end of the container body enclosing said upper outer series of shallow recesses, said container body including a threaded outer portion extending about the circumference of said body beneath said recesses, and said cap having an inner threaded portion adapted to cooperate with said outer threaded portion for securing the cap to the body in a manner so as not the damage said recesses.

2. The container as recited in claim 1 wherein said cap includes a first skirt portion disposed above said cap threaded portion and a second skirt portion disposed below said cap threaded portion said first skirt portion having a smaller inner diameter than said second skirt portion.

3. A moisture-proof, multi-compartment container comprising:

a container body having side walls, a bottom wall and an open upper end, a plurality of walls disposed within said body arranged to define a plurality of chambers in combination with the chamber side walls and extending vertically substantially the length of said body to open to said open upper end, and an upper outer portion disposed adjacent said chambers and adapted to receive indicia, to label the contents of the chambers;

a selector plate rotatably mounted on said upper open portion of said container body, said selector plate having a selector aperture to be selectively aligned with one of said chambers for dispensing product from the selected chamber, said selector plate further including an upwardly extending projection adapted to be manually gripped to rotate said selector plate, said projection including a generally Y-shaped surface portion having a forked portion which defines said selector plate aperture and forms a funnel to guide product into the aperture; and a sealing cap adapted to engage said container body to form a moisture-proof seal therewith, said cap extending over and around the upper end of the container body enclosing said upper outer indicia receiving portion, said cap and said container body having means for securing the cap to the body in a manner so as not to damage the indicia receiving portion.

4. A moisture-proof multi-compartment container comprising:

a generally cylindrical shaped container body, said container body comprising an integral bottom portion and an open upper end portion, a plurality of walls disposed within said body arranged to define a plurality of chambers having a generally wedge-shaped cross section and extending vertically substantially the length of said body;

a selector plate rotatably mounted on said upper open portion of said container body, said selector plate having a selector aperture sized to generally correspond to the shape of said wedge-shaped chambers, said selector plate further having a projection adapted to be manually gripped to rotate said dispenser plate, said projection including a forked portion defining said aperture and forming guide walls about the aperture; and a sealing cap adapted to engage said container body to form a moisture-proof seal therewith, said cap having an upper wall extending over said plate and surrounding the upper end of said body.

5. A moisture-proof multi-compartment container comprising:

a generally cylindrical shaped container body, said container body comprising an integral bottom portion and an open upper end open portion, a plurality of walls disposed within said body arranged to define a plurality of chambers having a generally wedged-shaped cross section and extending vertically substantially the length of said body, an outer-upper portion having a series of recesses, each of said recesses being radially aligned with one of said chambers and adapted to receive indicia to label the contents of said chambers, said body further having a threaded outer portion extending about the circumference of said body, said body threaded portion being disposed beneath said series of recesses;

a selector plate rotatably mounted on said upper open portion of said container body, said selector plate having a selector aperture sized to generally correspond to the shape of said wedge-shaped chambers, said selector plate further having a projection adapted to be manually gripped to rotate said dispenser plate; and a sealing cap adapted to enclose the upper end of said body and to engage said body to form a moisture-proof seal therewith, said cap having a seal on its upper inner surface, adapted to sealingly abut an upper rim of said container body, said cap further having an inner threaded portion adapted to engage said container body outer threaded portion, while not interfering with indicia within said recesses, said cap being slightly spaced from said recesses when on the container body.

6. The container as recited in claim 5 wherein said plate projection extends generally diametrically across the plate and is arched slightly to be higher in the center to provide a convenient finger gripping area, and said cap has an upper wall which has a shallow dome shape to accommodate said plate projection.

* * * * *